US011253086B1

(12) United States Patent
Huang

(10) Patent No.: US 11,253,086 B1
(45) Date of Patent: Feb. 22, 2022

(54) HANGING STRUCTURE FOR PAINTING TOOL

(71) Applicant: Chin-Chen Huang, Taichung (TW)

(72) Inventor: Chin-Chen Huang, Taichung (TW)

( * ) Notice: Subject to any disclaimer, the term of this patent is extended or adjusted under 35 U.S.C. 154(b) by 0 days.

(21) Appl. No.: 16/990,978

(22) Filed: Aug. 11, 2020

(51) Int. Cl.
*A47F 5/00* (2006.01)
*A47F 7/00* (2006.01)
*B44D 3/16* (2006.01)

(52) U.S. Cl.
CPC ..... *A47F 5/0006* (2013.01); *B44D 3/164* (2013.01); *A47F 7/0042* (2013.01)

(58) Field of Classification Search
CPC ..... A47F 5/0006; A47F 7/0042; A47F 2005/0012; A47F 7/143; B44D 3/164; B44D 3/162; A47G 25/005; B65D 5/4208; A47L 13/02; A47L 13/022; A47L 13/08; B25G 1/00; B25G 1/10; B25G 1/102
USPC ..... 211/113, 66, 70.6; 206/806, 750; 15/236.01; 7/105; 30/69; 81/489, 492, 81/487; 248/690
See application file for complete search history.

(56) References Cited

U.S. PATENT DOCUMENTS 869,379 A * 10/1907 Mills ..... A47F 5/0006 248/690
1,691,857 A * 11/1928 Paula ..... A46B 11/0093 15/248.1
2,352,406 A * 6/1944 Pond ..... B25G 1/00 248/685
3,302,917 A * 2/1967 Winkler ..... A47F 5/0006 248/317
3,670,414 A * 6/1972 Stecker ..... B44D 3/164 30/338
3,749,348 A * 7/1973 Bartlett ..... F41C 33/00 248/690
3,855,700 A * 12/1974 Gerson ..... B44D 3/164 30/162
4,202,093 A * 5/1980 Wallerstein ..... A47L 13/08 15/236.01
4,574,417 A * 3/1986 Magnasco ..... A47L 13/08 15/236.05
4,607,752 A * 8/1986 Sherrow ..... B25B 11/00 211/65

(Continued)

FOREIGN PATENT DOCUMENTS

DE 202016003180 U1 * 6/2016 ..... E04F 21/163
FR 2969192 A1 * 6/2012 ..... B25G 1/08

*Primary Examiner* — Jennifer E. Novosad

(57) ABSTRACT

A hanging structure for a painting tool includes a body, a knife board, and two side covers. The body comprises an abutting part on a bottom surface, a protruding board, and two buckling recesses. A clamping slot is formed between the abutting part and the protruding board, whereas the two buckling recesses are in both ends of the body, respectively, and each buckling recess has a first engaging part. The knife board is assembled into the clamping slot, so it can abut the abutting part. The two side covers are assembled into the two buckling recesses, respectively. Each side cover has a second engaging part that engages with the first engaging part, and at least one side cover has a hanging part that protrudes from the outer surface of the side cover. The second engaging part is engaged with the first engaging part, whereas the hanging part protrudes from the outer surface of the side cover.

9 Claims, 8 Drawing Sheets

(56) References Cited

U.S. PATENT DOCUMENTS 4,771,897 A * 9/1988 Ho ..... A47G 29/10 211/85.9
5,321,868 A * 6/1994 Coulson ..... B41F 15/02 101/114
5,337,523 A * 8/1994 Walsh ..... B24D 15/04 15/245
5,363,957 A * 11/1994 Reichner ..... A47F 5/0006 15/220.4
5,433,004 A * 7/1995 Thompson ..... A47L 13/08 30/169
5,582,387 A * 12/1996 Kolton ..... A47G 25/743 211/118
5,740,927 A * 4/1998 Yemini ..... A47B 96/067 211/66
5,809,608 A * 9/1998 Zadro ..... B41F 15/44 15/245
5,924,204 A * 7/1999 Lane ..... A47L 13/022 30/169
6,152,312 A * 11/2000 Nava ..... A47B 61/003 211/94.01
6,308,841 B1 * 10/2001 Donnelly ..... A47B 55/02 211/181.1
6,431,373 B1 * 8/2002 Blick ..... B25H 3/003 206/378
6,698,603 B2 * 3/2004 Lawson ..... A47F 5/0846 211/94.01
6,729,468 B1 * 5/2004 Dobmeier ..... B23D 59/00 206/303
7,111,422 B2 * 9/2006 Wheeler ..... B65D 67/02 206/378
7,344,118 B2 * 3/2008 Samberg ..... B25H 3/006 206/349
8,251,343 B2 * 8/2012 Zhang ..... A47F 5/0006 248/691
8,864,097 B2 * 10/2014 Wang ..... F16M 13/005 248/551
9,234,358 B2 * 1/2016 Harper ..... E04F 21/162
9,393,708 B2 * 7/2016 Babaev ..... B21D 53/60
D837,464 S * 1/2019 Park ..... D30/159
D911,137 S * 2/2021 Ventura ..... D8/45
2004/0217249 A1 * 11/2004 Eisenbraun ..... A47F 5/0006 248/323
2010/0193454 A1 * 8/2010 Thompson ..... A47F 5/0006 211/70.6
2018/0281023 A1 * 10/2018 Koch ..... B25G 3/24
2019/0024391 A1 * 1/2019 Huang ..... E04F 21/026
2019/0090713 A1 * 3/2019 Krieg ..... B08B 7/04
2019/0134831 A1 * 5/2019 Chiu ..... A47L 13/08
2020/0189089 A1 * 6/2020 Chin-Chen ..... B05C 17/10

* cited by examiner

HANGING STRUCTURE FOR PAINTING TOOL

BACKGROUND OF THE INVENTION

1. Field of the Invention

The present invention is a hanging structure for a painting tool, and is in particular a type of structure in which the body and the side covers can be engaged with each other through a concave-convex engagement design, so as to increase their combined strength.

2. Description of the Related Art

A conventional paint squeegee is used for leveling the surface of a pre-painted wall. In general, a paint squeegee comprises a handle and a blade which is screwed onto the handle.

However, the disadvantage of this type of combination is, when a user needs to replace the blade, an additional tool such as a wrench or a screwdriver is required to remove the screw before the blade can be disassembled and assembled. In addition, after the screw is tightened for a period of time or is tightened repeatedly, the screw is prone to loosening, thereby making it inconvenient to use.

In the case of the painting tool disclosed in R.O.C. Patent No. 1646243, its knife board can be easily engaged with or removed from the clamping slot, thereby effectively overcoming the inconvenience arising from the assembly and disassembly of the knife board. However, the side covers of this design are only connected to the body in a way that multiple positioning bodies are attached to the inner circumferential surface of fastening holes, and their combined strength is slightly inadequate. Furthermore, there is no hanging design on the exterior of the design, whereas this design is also relatively inconvenient, storage-wise, and takes up space.

Therefore, the inventor of the present invention has actively carried out researches and improvements for years using his practical experiences in Zo related designs. In addition, the inventor has created and tested physical samples multiple times, thereby making improvements on the shortcomings mentioned above, and eventually completing the present invention

SUMMARY OF THE INVENTION

An objective of the present invention is to provide hanging structure for a painting tool which is capable of improving the above-mention problems.

To overcome the shortcomings above, an embodiment of the present invention offers a hanging structure for a painting tool, which allows the body and the side covers to connect to each other in a stable manner through a concave-convex engagement between the first engaging part and the second engaging part.

An embodiment of the present invention is a hanging structure for a painting tool, including a body, a knife board, and two side covers. The body comprises a grip part, an abutting part, a protruding board, two buckling recesses, a first side edge, and a second side edge. The grip part is located on the first side edge of the body, and protrudes from the upper surface of the body. The abutting part is formed on the bottom surface of the body and extends from the bottom of the grip part toward the second side edge. A clamping slot is formed between the protruding board and the abutting part, and the opening of the clamping slot faces the second side edge. The two buckling recesses are recessed in both ends of the body, respectively, and each buckling recess has a first engaging part. The knife board comprises a blade part and a connecting part which is connected to the blade part, and an included angle is formed between the blade part and the connecting part. The connecting part can be assembled into the clamping slot, so that the knife board can abut the abutting part. The two side covers are assembled into the two buckling recesses, respectively. Each side cover has a second engaging part, and at least one side cover has a hanging part that protrudes from the outer surface of the side cover. The second engaging part is engaged with the first engaging part, whereas the hanging part protrudes from the outer surface of the side cover.

In some embodiments, the side covers have multiple positioning bodies, and each positioning body is attached to the inner circumferential surface of the buckling recess.

In some embodiments, the first engaging part is a through hole which penetrates the body, whereas the second engaging part is a protrusion which is set to one of the positioning bodies.

In some embodiments, the hanging part comprises a hanging hole and a reinforcing protruding part. The reinforcing protruding part is set to the end of the hanging part and is extended and connected to the hanging hole.

Other objects, advantages, and novel features of invention will become more apparent from the following detailed description when taken in conjunction with the accompanying drawings.

DETAILED DESCRIPTION OF THE PREFERRED EMBODIMENT

Figure 1:
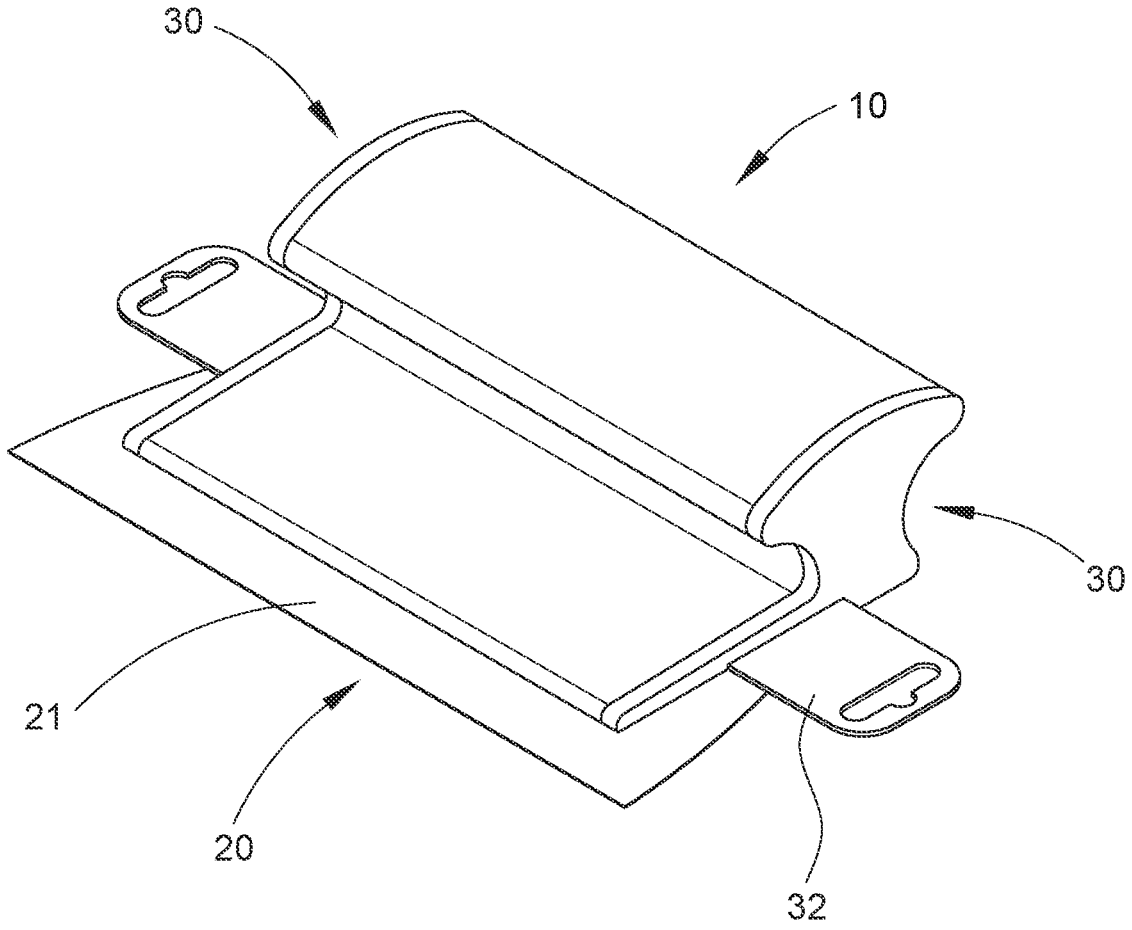
FIG. 1 is a perspective view of an embodiment hanging structure for a painting tool.

Referring to FIG. 1 to FIG. 6, these figures show the hanging structure of a painting tool, comprising a body 10, a knife board 20, and two side covers 30.

With regard to the body 10, it comprises a grip part 11, an abutting part 12, a protruding part 13, two buckling recesses 14, a first side edge 10*a*, and a second side edge 10*b*. The grip part 11 is located on the first side 10*a* of the body 10, and protrudes from the upper surface of the body 10. The abutting part 12 is formed on the bottom surface of the body 10 and extends from the bottom of the grip part 11 toward the second side edge 10*b*. A clamping slot 15 is formed between the protruding board 13 and the abutting part 12, and the opening of the clamping slot 15 faces the second side edge 10*b*. There is a limiting body 151 in the opening of the clamping slot 15, where the limiting body 151 protrudes from the clamping slot 15, and the limiting body 151 can be a long strip or multiple protrusions. Moreover, the two buckling recesses 14 are in opposite ends of the body 10, respectively, and each buckling recess 14 has a first engaging part 141.

Figure 2:
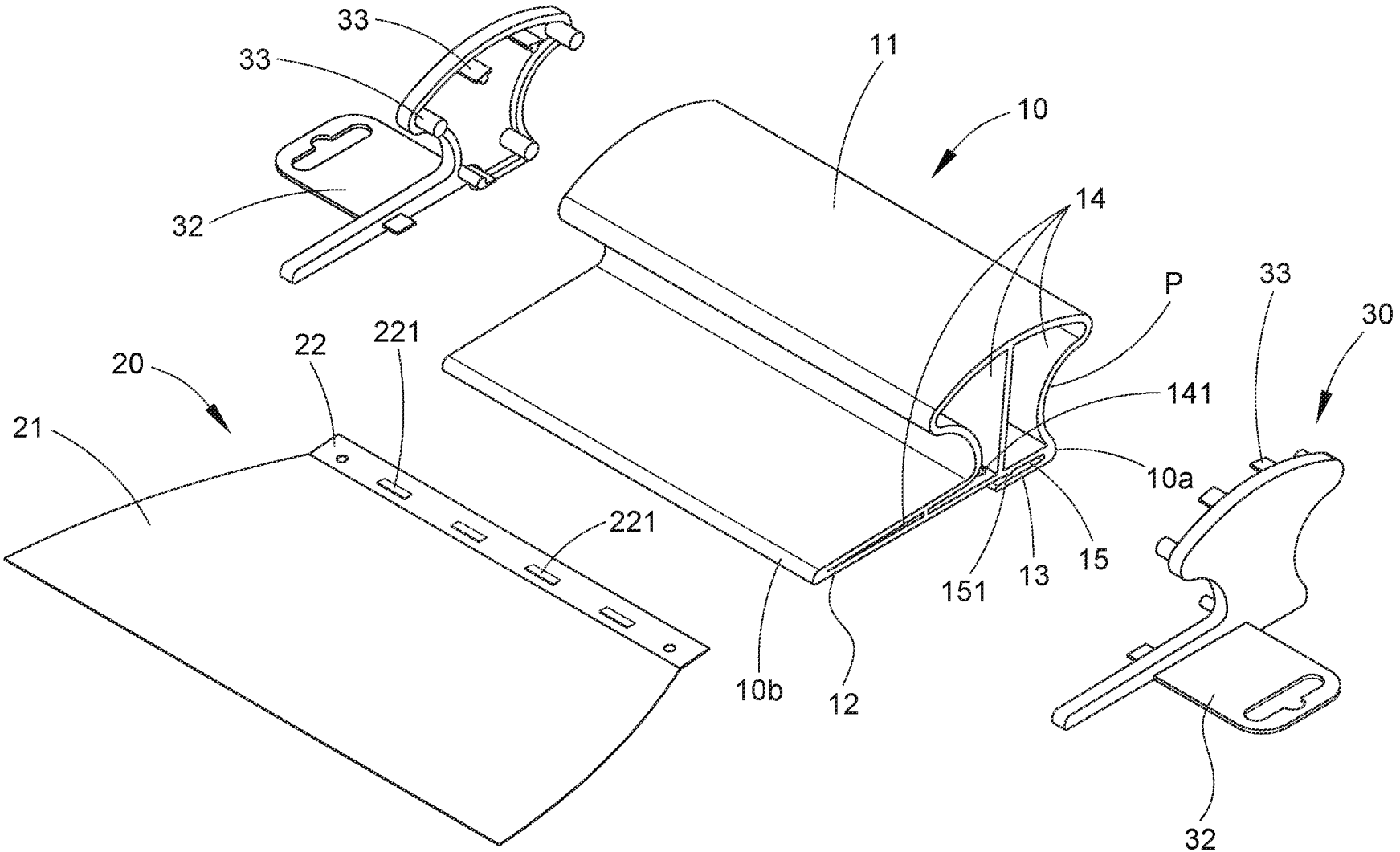
FIG. 2 is an exploded view of an embodiment hanging structure for a painting tool.

As shown in FIG. 2, in this example, the top of the grip part 11 has a circular arc surface, whereas the two side surfaces connecting to the top and bottom of the grip part 11 form a concave inner recess P, and the top section of the grip part 11 is larger than the bottom section. This way, the concave inner recess P can be gripped by the user with his/her fingers, so that the grip part 11 can be gripped easily.

In this example, the body 10 is a hollow structure to save on the manufacturing materials of the body 10 and reduce the weight of the body 10, so that the two buckling recesses 14 are connected to each other, and the buckling recesses 14 are composed of multiple holes.

The knife board 20 comprises a blade part 21 and a connecting part 22 which is connected to the blade part 21. The knife board 20 can be connected to the clamping slot 15 of the body 10. Moreover, the connecting part 22, preferably, has multiple positioning parts 221, and the multiple positioning parts 221 are to be latched onto the limiting body 151, so that the knife board 20 can be firmly connected to the clamping slot 15. The multiple positioning parts 221 are formed by stamping so that the positioning parts 221 protrude from the bottom surface of the connecting part 22; thus, these parts can be easily processed and formed. The blade part 21 can be used for leveling the wall or the ground, and an obtuse angle θ is formed between the connecting part 22 and the blade part 21. The angle θ ranges between 150° and 170° (preferably 160°), so that the knife board 20 can abut the abutting part 12 when the connecting part 22 is assembled into the clamping slot 15.

The two side covers 30 are assembled into the two buckling recesses 14, and each side cover 30 has a second engaging part 31 and a hanging part 32. The second engaging part 31 is connected to the first engaging part 141, whereas the hanging part 32 protrudes from the outer surface of the side cover 30. The hanging part 32 comprises a hanging hole 321 and a reinforcing protruding part 322. The reinforcing protruding part 322 is set to the end of the hanging part 32 and is extended and connected to the hanging hole 321, which can increase the structural strength at the end of the hanging part 32, and thus enhances stability when hung, as well as preventing damage to the end of the hanging part 32 when hung over a long period of time.

In this example, the side covers 30 have multiple positioning bodies 33. Each positioning body 33 can be extended into the buckling recess 14 and complement each other, or each positioning body 33 is attached to the inner circumferential surface of the buckling recess 14, so that the two side covers 30 can be connected to the surface on both ends of the body 10.

Figure 3:
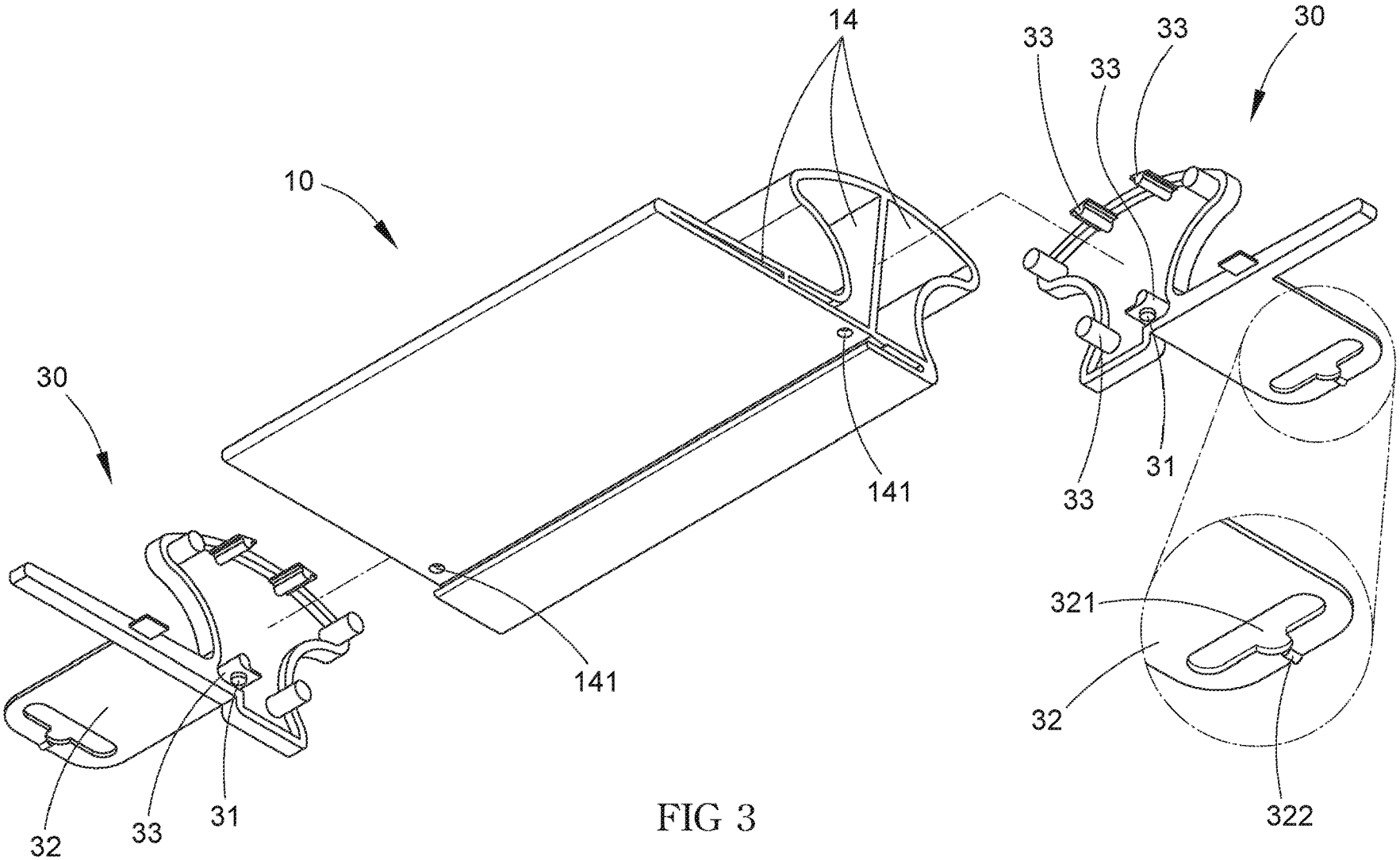
FIG. 3 is another perspective view of a hanging structure for a painting tool.
Figure 4:
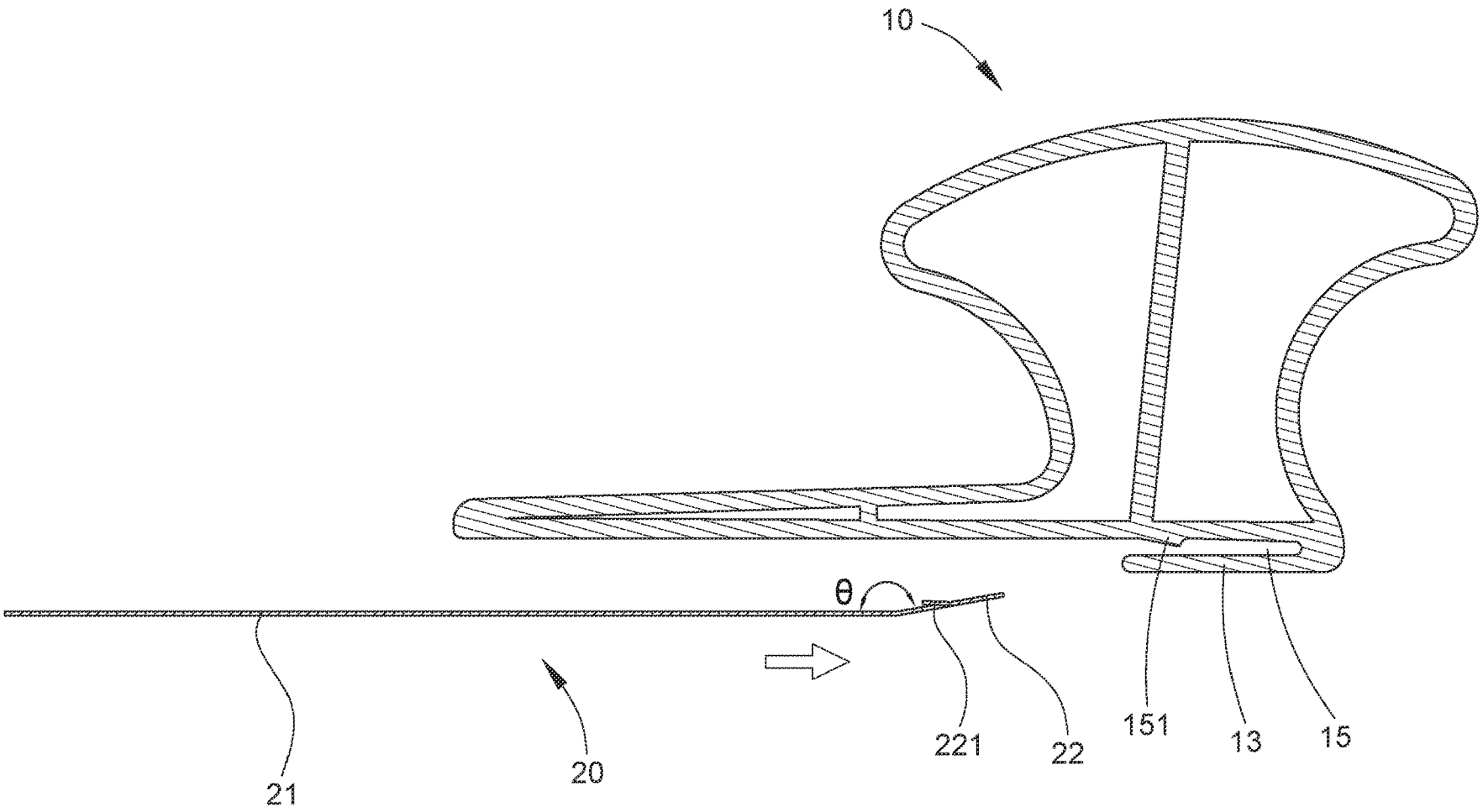
FIG. 4 is a cross-sectional view of a breakdown side of an embodiment hanging structure for a painting tool.
Figure 5:
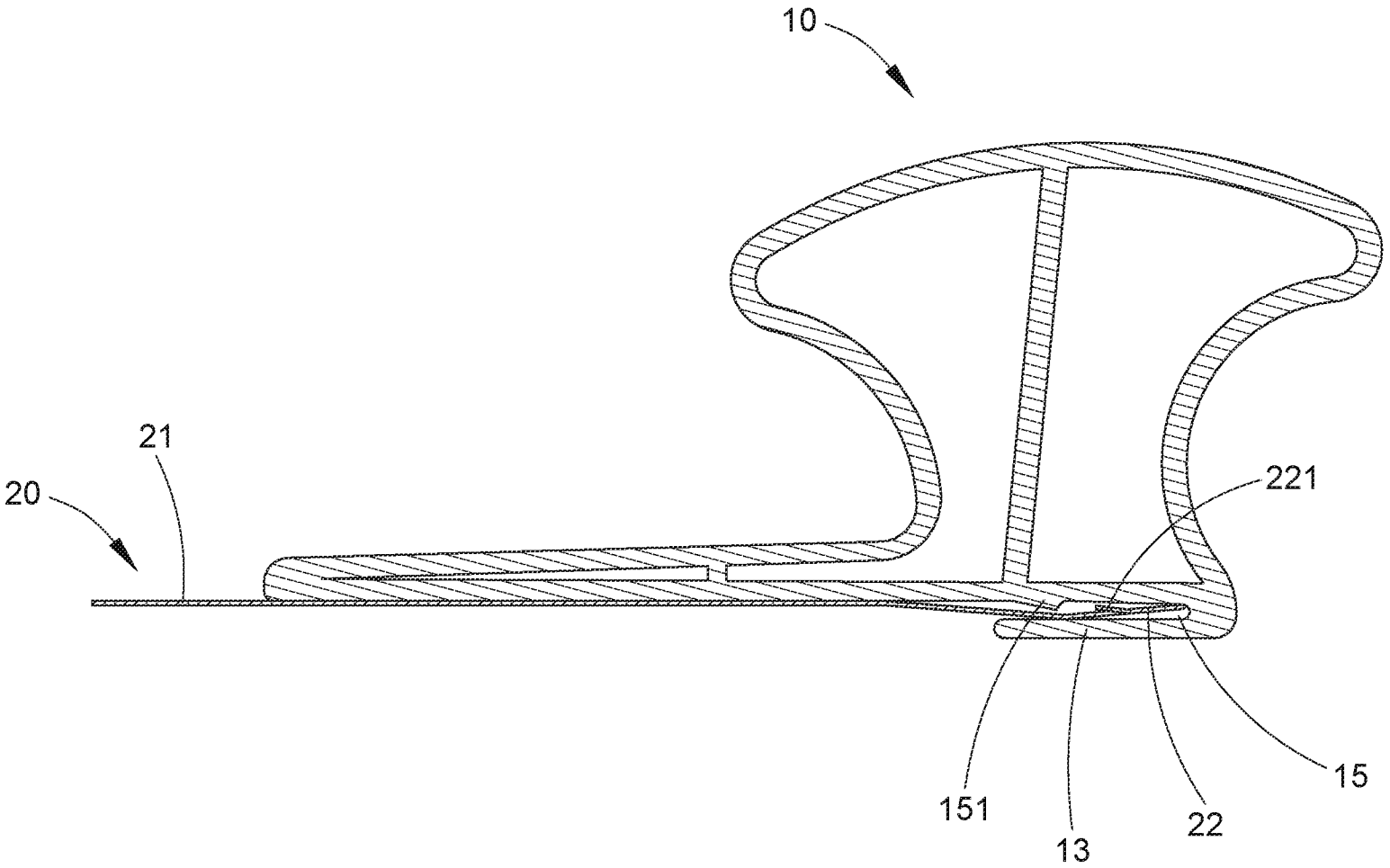
FIG. 5 is a cross-sectional view of an assembly side of an embodiment hanging structure for a painting tool.
Figure 6:
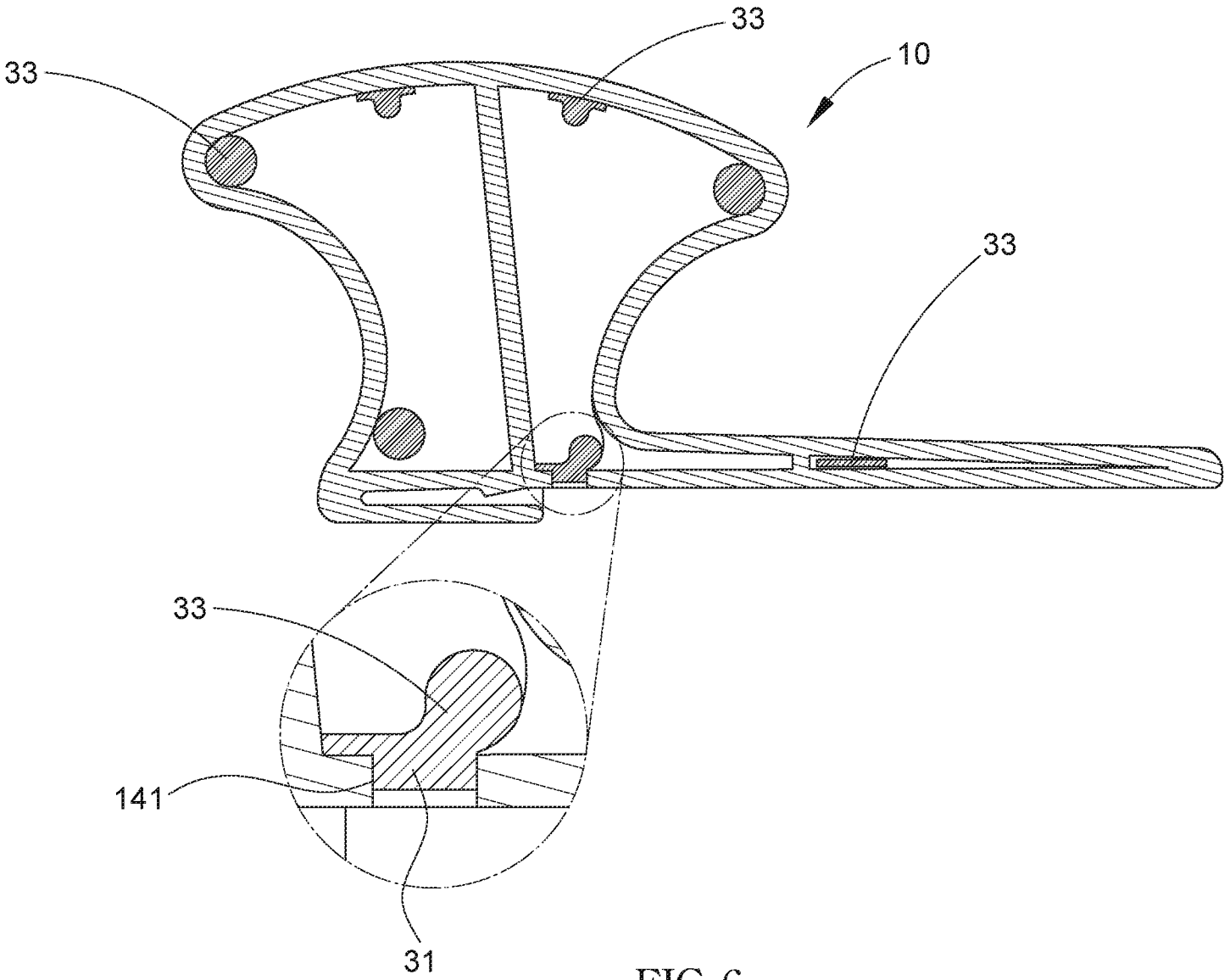
FIG. 6 is a cross-sectional view illustrating engagement positions of a body and side covers in an embodiment.

As shown in FIG. 3 and FIG. 6, in this example, the first engaging part 141 is a cylindrical through hole (or slot) which penetrates the body 10, whereas the second engaging part 31 is a cylindrical protrusion which is set to the bottom surface of one of the positioning bodies 33. When the side cover 30 is assembled into the buckling recess 14, the cylindrical protrusion (the second engaging part 31) is engaged in the cylindrical through hole to form a concave-convex engagement, so that the side cover 30 does not easily separate from the body 10. The abovementioned concave-convex engagement is only an example and is not intended to limit the present invention. In other embodiments, the first engaging part 141 can also be designed as a protrusion, whereas the second engaging part 31 can be a cylindrical through hole which penetrates one of the positioning bodies 33, so as to achieve a concave-convex engagement.

Therefore, the two side covers 30 not only hide the buckling recesses 14 to enhance the appearance of the body 10, but can also prevent lateral shift of the knife board 20 during use (i.e. having a limiting effect). The mutual engagement between the first engaging part 141 and the second engaging part 31 can effectively increase the combined strength of the side covers 30 and the body 10.

Figure 7:
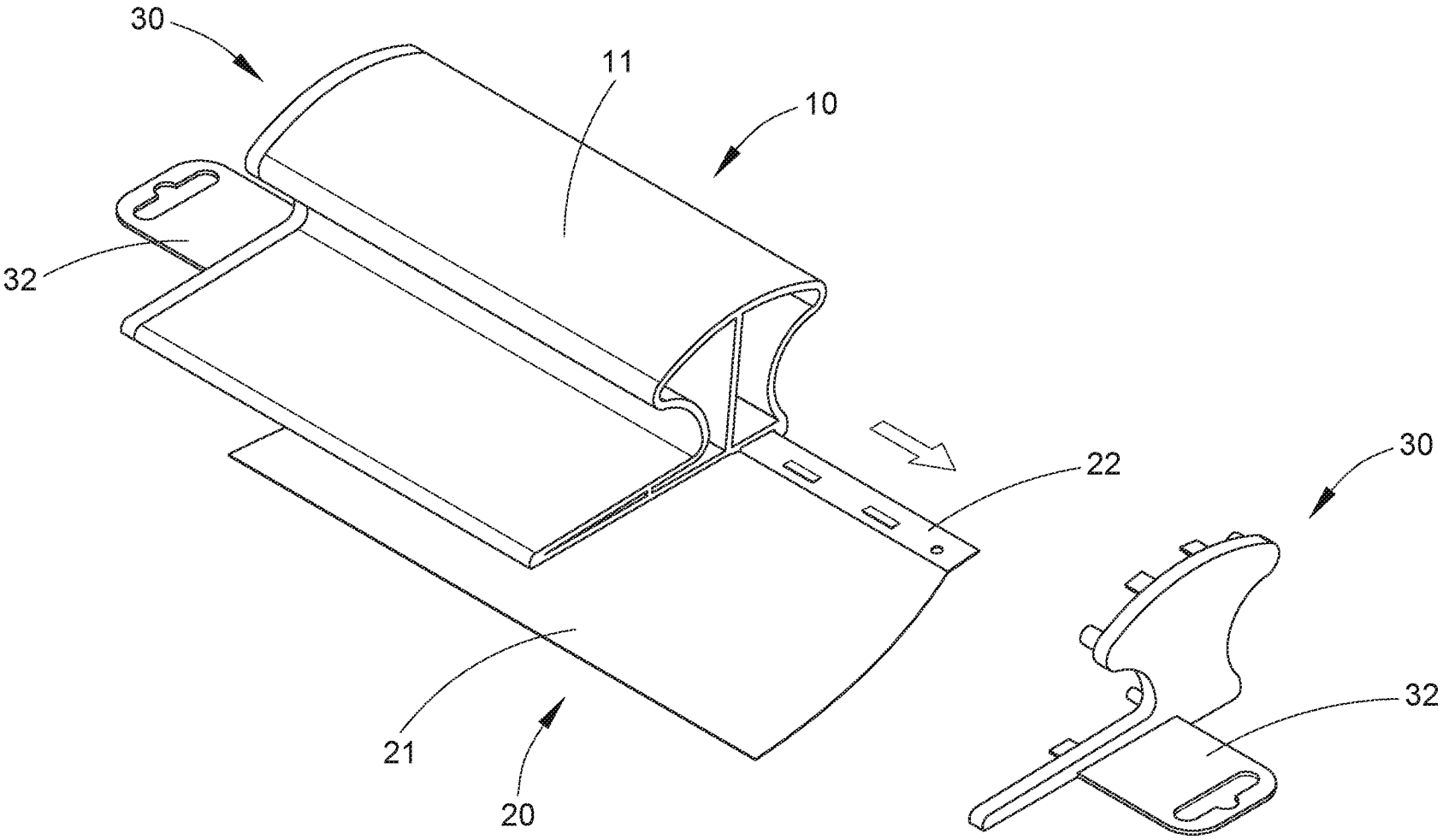
FIG. 7 illustrates an embodiment when hung on a hook.

Referring to FIG. 7, when the knife board 20 needs to be replaced, only the side cover 30 at one end of the body 10 needs to be taken out. The knife board 20 is moved laterally from the body 10, so that the knife board 20 can be taken out smoothly. Another knife board 20 can be inserted into the clamping slot 15 of the body 10 through the connecting part 22. This way, the knife board 20 can be easily replaced without any tool, demonstrating convenience in replacing the knife board 20.

Figure 8:
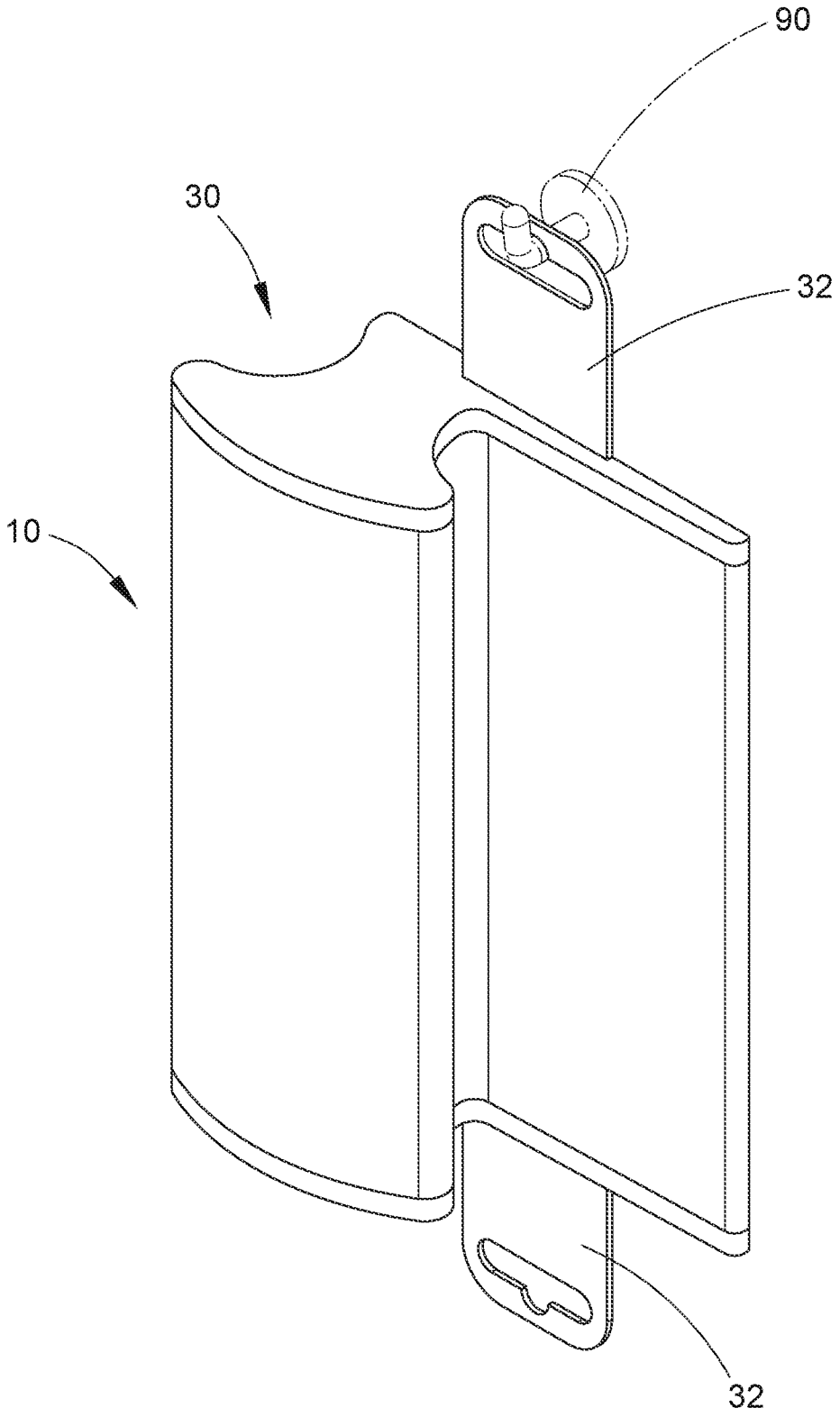
FIG. 8 is a perspective view of an embodiment after it is dismantled.

As shown in FIG. 8, the hanging part 32 can be hung and fixed on a hook 90 on a wall, so that the hanging structure for an embodiment painting tool has several advantages, i.e. it is easy to store and does not take up space. Additionally, the design in which the two side covers 30 have the hanging part 32, enables both ends of the embodiment of the present invention to have the hanging function. Whether the users are right-handed or left-handed, it can be hung smoothly using the dominant hand after use.

It should be noted that with regard to the design of the side covers 30 in embodiments of the present invention, not only is each positioning body 33 attached to the inner circumferential surface of the buckling recess 14 and assembled onto the body 10, but the fixed strength between the side covers 30 and the body 10 can be effectively increased through a concave-convex engagement between the second engaging part 31 and the first engaging part 141. Particularly for the side covers 30 set to the hanging part 32, this design can prevent separation of the body 10 from the side covers 30 due to the weight of the body 10 when hung.

Although the present invention has been explained in relation to its preferred embodiment, it is to be understood that many other possible modifications and variations can be made without departing from the spirit and scope of invention as hereinafter claimed.

What is claimed is:

1. A hanging structure for a painting tool comprising:

a body comprising a grip part, an abutting part, a protruding board, two buckling recesses, a first side edge, and a second side edge, the grip part located on the first side edge of the body and protruding from an upper surface of the body, and the abutting part formed on a bottom surface of the body and extending from a bottom of the grip part toward the second side edge, a clamping slot formed between the protruding board and the abutting part, and an opening of the clamping slot facing the second side edge, the two buckling recesses disposed in opposing ends of the body, respectively, and each buckling recess having a respective first engaging part;

a knife board comprising a blade part and a connecting part connected to the blade part, an angle formed between the connecting part and the blade part, the angle being between 150° and 170°, the connecting part insertable into the clamping slot, the knife board abutting the abutting part; and two side covers assembled into the buckling recesses, respectively, each side cover having a second engaging part, and at least one of the side covers having a hanging part, the second engaging parts and the first engaging parts engaging with each other, and the hanging part protrudes from an outer surface of the side cover;

wherein the first engaging part is a through hole which penetrates the body, and the second engaging part is a protrusion.

2. The hanging structure for a painting tool as claimed in claim 1, wherein a top section of the grip part has a circular arc surface, and two sides connecting to a top and the bottom of the grip part form a concave recess, and the top section of the grip part is larger than a bottom section of the grip part.

3. The hanging structure for a painting tool as claimed in claim 1, wherein a limiting body is disposed in the opening of the clamping slot, and the connecting part has a plurality of positioning parts, each positioning part formed by stamping, the positioning parts protruding from the connecting part, each positioning part configured to latch onto the limiting body, and the limiting body is a strip or comprises multiple protrusions.

4. The hanging structure for a painting tool as claimed in claim 1, wherein the body is a hollow structure connecting the two buckling recesses to each other.

5. The hanging structure for a painting tool as claimed in claim 1, wherein a concave-convex engagement exists between the first engaging part and the second engaging part.

6. The hanging structure for a painting tool as claimed in claim 1, wherein each of the side covers has multiple positioning bodies, and each positioning body complements the respective buckling recess.

7. The hanging structure for a painting tool as claimed in claim 1, wherein each of the side covers has multiple positioning bodies, and each positioning body is attached to an inner circumferential surface of the respective buckling recess.

8. The hanging structure for painting tool as claimed in claim 1, wherein the first engaging part of each buckling recess is a through hole which penetrates the body, and the second engaging part of each side cover is a protrusion on a positioning body of the side cover.

9. The hanging structure for a painting tool as claimed in claim 1, wherein the hanging part comprises a hanging hole and a reinforcing protruding part, and the reinforcing protruding part extends from an end of the hanging part to the hanging hole.

* * * * *